United States Patent [19]

Anderson et al.

[11] 3,938,438

[45] Feb. 17, 1976

[54] PRESSURE-ARMED EXPLOSIVE APPARATUS

[75] Inventors: Matthew E. Anderson, Ontario; Stephen L. Redmond, China Lake, both of Calif.; John W. Horky, Naperville; Leo V. Krolak, Northbrook, both of Ill.

[73] Assignee: The United States of America as represented by the Secretary of the Navy, Washington, D.C.

[22] Filed: Apr. 12, 1971

[21] Appl. No.: 133,364

[52] U.S. Cl. ..... 102/7.2; 102/81

[51] Int. Cl.[2] ..... F42B 25/16; F42C 15/12

[58] Field of Search ..... 102/7.2, 81, 49.5, 6

[56] References Cited

UNITED STATES PATENTS

| | | | |
|---|---|---|---|
| 2,809,583 | 10/1957 | Ortynsky et al. | 102/7.2 |
| 2,926,609 | 3/1960 | VanGoey et al. | 102/81 X |
| 2,996,985 | 8/1961 | Kratzer | 102/7.2 |
| 3,170,398 | 2/1965 | Paulson et al. | 102/6 |
| 3,318,241 | 5/1967 | Gould | 102/7.2 |
| 3,453,960 | 7/1969 | Qualls | 102/49.5 |
| 3,646,889 | 3/1972 | Davis | 102/7.2 |

*Primary Examiner*—Samuel Feinberg
*Assistant Examiner*—C. T. Jordan
*Attorney, Agent, or Firm*—R. S. Sciascia; G. J. Rubens; T. M. Phillips

[57] ABSTRACT

An air droppable sealed warhead cannister capable of housing a plurality of bomblets, each bomblet having a pressure-sensitive fuze capable of being controlled by the presence and absence of a predetermined pressure in the cannister.

5 Claims, 10 Drawing Figures

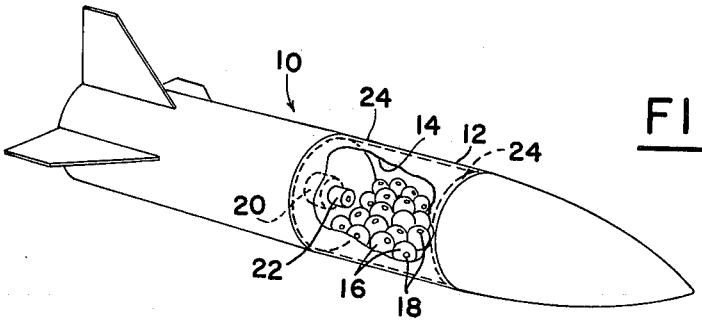
FIG. 1
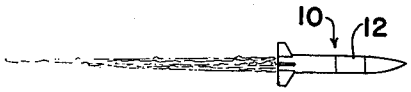
FIG. 2
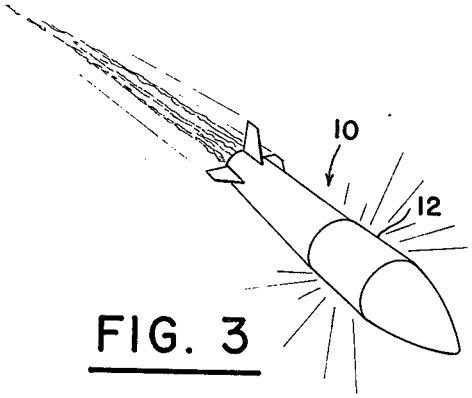
FIG. 3
FIG. 4
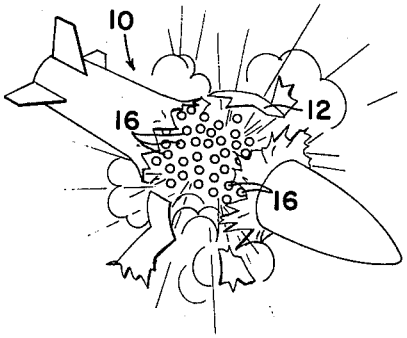
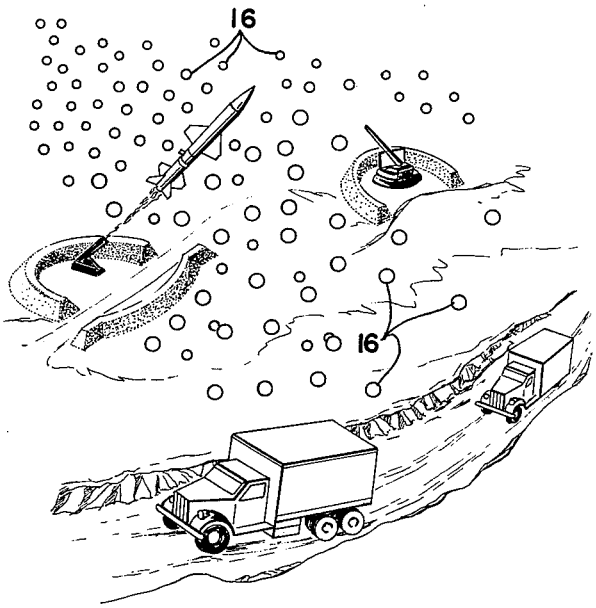
FIG. 5
INVENTORS
MATTHEW E. ANDERSON
STEPHEN L. REDMOND
JOHN W. HORKY
LEO V. KROLAK
BY George J. Rubens
ATTORNEYS FIG. 6
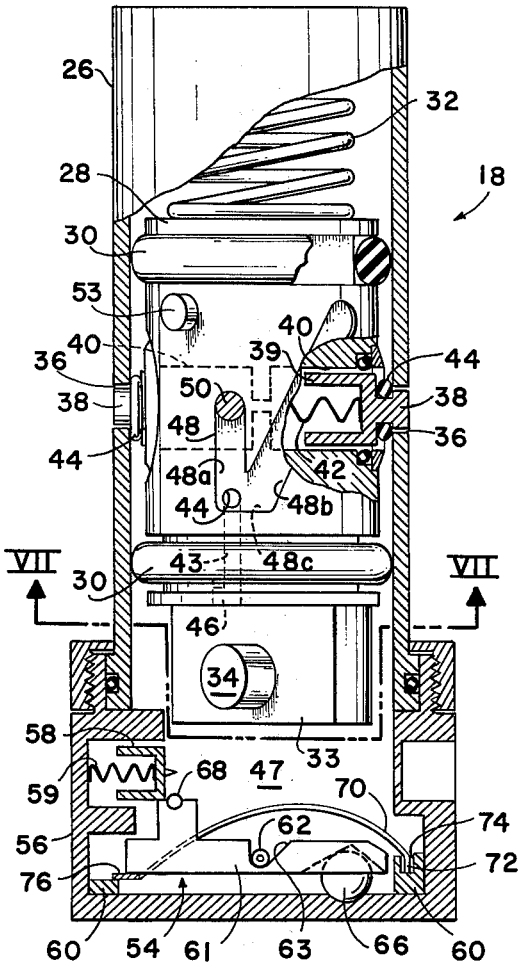
FIG. 8
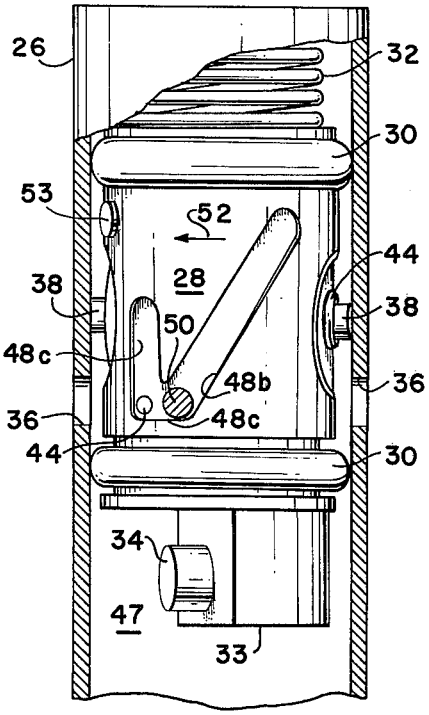
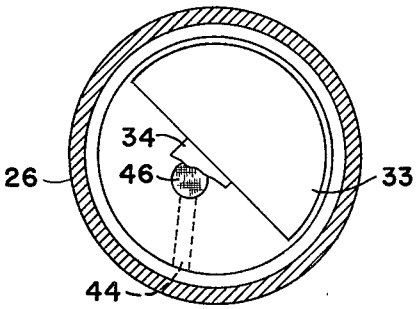
FIG. 7
INVENTORS
MATTHEW E. ANDERSON
STEPHEN L. REDMOND
JOHN W. HORKY
LEO V. KROLAK
BY
George J. Lubar
ATTORNEYS FIG. 9
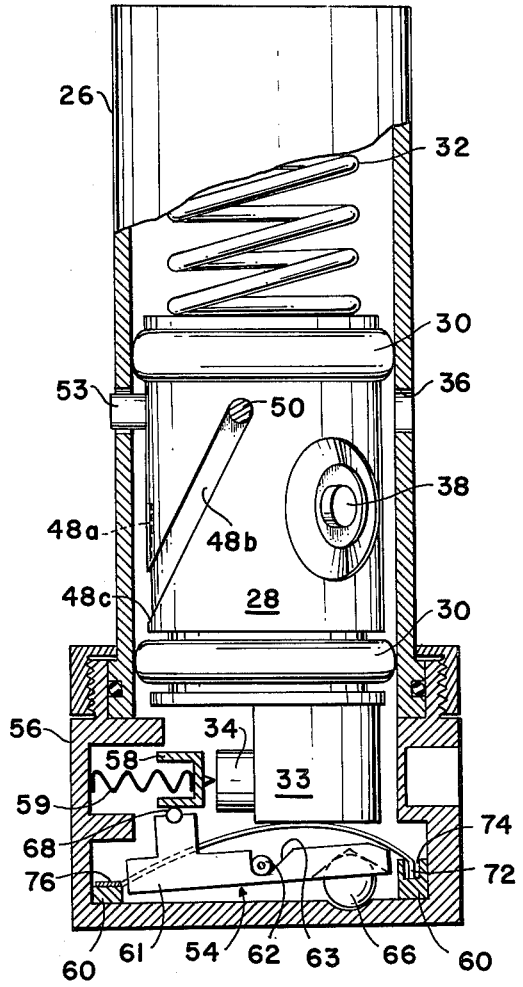
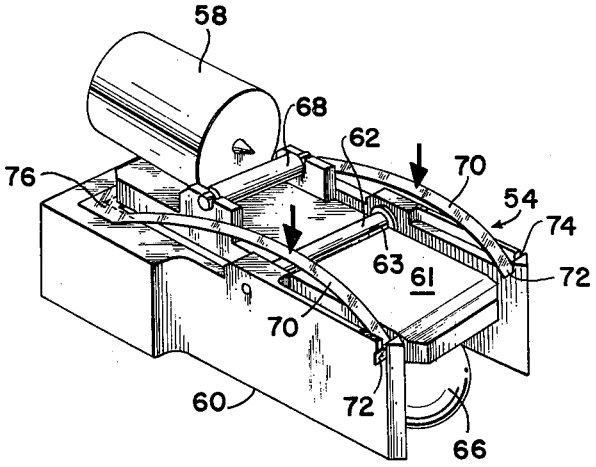
FIG. 10
INVENTORS
MATTHEW E. ANDERSON
STEPHEN L. REDMOND
JOHN W. HORKY
LEO V. KROLAK
BY George J. Rubens
ATTORNEYS

PRESSURE-ARMED EXPLOSIVE APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to ordnance devices, and more particularly to an air-droppable missile housing a plurality of individual bomblets having pressure-sensitive fuzes that can be armed and detonated automatically, independently of a spinning momentum.

Bomblets presently in use employ fuzes that are spin-armed aerodynamically by flutes formed on the outer surfaces of the bomblets. The reliance on spin arming of such fuzes is unacceptable for Navy use due to the hazard presented by accidental spillage on deck causing bomblet arming and firing. Recent Navy safety directives limit the use of spin-armed cluster weapons in that they cannot be brought back aboard an aircraft carrier by strike aircraft because of the hazard presented by an arrested landing. In such a sudden stop, the bomblets could spill out, roll across the deck and detonate through the spinning action. Similarly, a takeoff by an aircraft from a land-based runway in the presence of friendly personnel can also be hazardous. Another objection to spin-armed bomblet fuzes is that they require the bomblet to be oriented to the proper spin attitude and reach a minimum spin rate before arming is initiated. This requirement dictates a minimum release altitude to achieve bomblet arming which will most likely be undesirable in many future weapons. Still another disadvantage of spin-armed bomblets is that a hole forms in the center of the bomblet pattern on the ground due to magnus dispersion when released from high altitudes necessitating the overlapping of several bombing patterns to achieve maximum coverage.

SUMMARY OF THE INVENTION

The invention device utilizes a construction which eliminates many disadvantages associated with spin-armed ordnance. The device includes an airtight cannister section housing a plurality of bomblets each bomblet having a pressure-sensitive fuze. When the device has travelled a safe distance from the launch vehicle, means are initiated to admit a high pressure fluid, i.e., gas to the cannister section to activate each fuze to a "commit-to-arm" condition. When the device reaches the intended delivery area the cannister is burst open to disperse the bomblets. The drop in pressure in each fuze causes the fuze to advance to an "armed" condition. The fuzes have a built-in time delay to assure that the bomblets have been sufficiently dispersed from each other before they are activated to an "armed" condition; thus avoiding premature explosion by accidental collisions. Upon impact with the intended targets each bomblet is ignited.

A higher degree of safety is achieved with the pressure-armed invention fuze than is presently attained with spin-type fuzes which is an important criteria for ship-based strike aircraft deploying such ordnance devices. By committing all of the fuzes to arm simultaneously by a highly reliable weapon safety and arming device, rather than individually, the probability of inadvertent arming is much less, enhancing safety. An additional feature of the pressure-sensitive fuze is that the arming delay can be more accurately predicted lending itself more suitable for applications in future systems.

OBJECTS OF THE INVENTION

An important object of this invention is to provide an ordnance device having a plurality of pressure-sensitive bomblet fuzes which can be committed-to-arm simultaneously, and at a safe distance from the launching vehicle.

Still another object is to provide a predetermined delay in fully arming said fuzes after dispersal of said bomblets.

Other objects are to provide a safer fuze; to provide a fuze which will assure a more uniform dispersal pattern; to provide a fuze which does not rely upon a spinning moment for arming; and to provide a fuze that will occupy a volume less than 1 cubic inch.

Other objects, advantages and novel features of the invention will become apparent from the following detailed description of the invention when considered in conjunction with the accompanying drawings wherein:

BRIEF DESCRIPTION OF THE DRAWINGS

FIG. 1 is a perspective view of an ordnance delivery device with the skin of the warhead section broken away to show the random packaging of the bomblets;

FIG. 2 is a diagrammatic view of the ordnance device in the launch phase;

FIG. 3 is a diagrammatic view of the ordnance device with the warhead section pressurized after travelling a safe distance from the launching vehicle;

FIG. 4 is a diagrammatic view of the ordnance device when the warhead section is burst to distribute the bomblets;

FIG. 5 is a diagrammatic view of the bomblets being dispersed over the target area;

FIG. 6 is a longitudinal section of the bomblet fuze in a "safe" position;

FIG. 7 is a bottom view of the piston taken along lines VII—VII of FIG. 6;

FIG. 8 is a partial upper section of the fuze with the piston advanced and rotated to a "commit-to-arm" position; and FIG. 9 is a full longitudinal section of the bomblet fuze in an "armed" position wherein the firing mechanism is unlocked and released to initiate the explosive train upon impact with the target; and FIG. 10 is a perspective view of the firing pin and release mechanism.

DESCRIPTION OF THE PREFERRED EMBODIMENT

Referring to the drawings where like reference numerals refer to similar parts throughout the figures there is shown in FIG. 1 an armament weapon 10 which may be in the form of an air droppable, aerodynamic missile having a warhead section 12. A portion of the warhead section skin 14 is broken away to show the packaging of a plurality of bomblets 16 which can have any desired configuration. Each bomblet is provided with a pressure-sensitive fuze 18, the details of which are later described with reference to FIGS. 6–10 inclusive.

A gas generator 20 is mounted in missile 10 for pressuring the warhead section 12 to activate fuzes 18 through a weapon safety arming device 22 which may be activated from a remote position such as the launching vehicle, i.e., aircraft (not shown). One or more linear explosive charges 24 are disposed around warhead section 12 to open it and release the bomblets for a purpose presently to be described.

FIGS. 2 to 4 inclusive depict the operational phases of missile 10 from time of launch to time of deployment. In FIG. 2 the missile 10 is in the launch phase where both the weapon and the bomblets are in a "safe" condition.

After the missile 10 has travelled a safe distance from the launching vehicle, warhead section 12 is pressurized as shown in FIG. 3. As will be explained in detail, pressurizing seciton 12 automatically and simultaneously activates all the bomblet fuzes to a "commit-to-arm" condition.

In FIG. 4 missile 10 has reached the target area and linear explosive charges 24 are activated to burst the skin of the warhead, dispersing the bomblets. The release of the pressure in the warhead causes the fuzes to advance to an "arm" condition through a predetermined delay period which enables the bomblets to achieve an adequately safe dispersal pattern as shown in FIG. 5 before they are fully armed. This delay assures that the bomblets will not explode through accidental contact with other bomblets when initially dispersed.

The delay in a pressure-activated fuze can be accurately predetermined enabling this type of fuze to be used in a dual-mode ordnance system, that is, the warhead can be detonated as a compact unit against a hard point target or the bomblets dispersed for an area-type target. A spin-armed fuze cannot be used with this system because of the necessity of a low dispersal altitude.

Referring to FIG. 6 there is shown a preferred embodiment of a pressure-sensitive fuze 18 suitable for use in bomblets 16 (FIG. 1). Fuze 18 comprises a cylinder 26 having a bore, in which is slidable a piston 28 having a pair of spaced O-ring seals 30. A torsion-compression spring 32 is positioned between one end of the cylinder and the piston to bias the piston, when the fuze is at the "commit" point, to an arming position (downward in FIG. 6). In place of a single spring two springs can be provided, one spring to exert a compressional force, the other spring a torsional force on the piston. The lower end of the piston 28 terminates in a semi-cylindrical extension 33 transversely housing a stab sensitive detonator 34.

Intermediately formed in cylinder 26 is a pair of oppositely disposed apertures extending therethrough into the cylinder which apertures serve as inlet ports 36 for the admission of pressurized fluid, preferably gas from generator 20 (FIG. 1), into the cylinder. With fuze 28 in a "safe" condition as illustrated in FIG. 6, each port 36 is normally blocked by a respective detent 38 integral with a detent body 39 transversely housed in a recess 40 of piston 28. Each detent 38 is biased outwardly by a compression spring 42 to a locking position to engage and block corresponding port 36. An O-ring 44 is provided around detent 38 to seal the port when mated therewith. The seating of detents 38 in ports 36 provide a visual indication that fuze 18 is locked in a "safe" condition (FIG. 6) blocking ports 36 and preventing movement of piston 28. Detents 38 are disposed in an opposing transverse orientation in piston 28 in order that shock loads caused by accidental dropping will not jar both detents loose at the same time. (The arrangement of detents 38 are rotated 45° in the drawings from the true position in order to show all of the details.)

For one specific application, detent spring 42 is designed to allow the detent to be withdrawn from port 36 to unlock piston 26 from the safe condition (FIG. 6) when the pressure in warhead section 12 (FIG. 1) has reached a minimum of 40 psi.

A longitudinally drilled duct 43 is provided in piston 28 extending from port 44 leading to the space around piston 28 between O-rings 30 to the lower (or high pressure) end of piston 28 through a gas restrictor 46, the purpose of which will be later described. Consequently, fluid pressure admitted through ports 36 will be admitted to the high pressure chamber 47 to act on the bottom surfaces of piston 28 and force the piston upward against the action of arming spring 32.

One of the safety features of the present invention is to maintain detonator charge 34 in a safe position with respect to the firing mechanism until adequate arming pressure is developed in warhead cannister 12 and released. This is accomplished by forming a U-shaped cam slot 48 on the outer surface of piston 28, the slot being engageable by a cam pin 50 screwed or otherwise secured in the cylinder wall 26. As cylinder 26 is fixedly mounted within its corresponding bomblet, any rectilinear movement of piston 28 will cause a simultaneous rotational movement thereof depending on the slope of the cam slot.

Cam slot 48 is provided with two leg portions 48*a* and 48*b;* the former being substantially vertical and parallel to the longitudinal axis of the piston, the latter leg being angularly disposed. The two legs are connected by a horizontal base leg 48*c*. Port 44 is shown located in groove 48 but could be otherwise located as long as it communicates with ports 36.

As previously noted, when the fluid pressure in warhead section 12 builds up to 40 psi, detents 38 are fully depressed to unlock piston 28 from the cylinder. As the pressure builds up in chamber 47, piston 28 is moved upwardly to compress arming spring 32. When the pressure reaches 100 psi, piston 28 has travelled upwardly to a position where cam pin 50 enters portion 48*c* of the cam slot. Arming spring 32, exerting a torsional force on piston 28 in the direction of arrow 52, moves pin 50 laterally relative to the piston so that it is aligned with slot leg 48*b*. The fuze is now in a "commit-to-arm" condition (see FIG. 8). Locking detents 38 are likewise rotated away from their aligned position with respect to their ports 36. Prior to this condition if pressure is inadequate when pin 50 is still in slot portion 48*a*, the fuze will remain in a "safe" condition and return to the initial position (FIG. 6).

At an appropriate time in the operational deployment, depending on the selected target, the fluid pressure in cylinder 26 is dissipated to enable the fuze to complete the arming cycle. In the specific embodiment disclosed, this loss of pressure is achieved by bursting warhead section 12 through linear explosive charges 24 to disperse bomblets 16, as is illustrated in FIG. 4. Piston 28 now commences a return stroke and as cam pin 50 rides in slot leg portion 48*b*, piston 28 commences to rotate, in the direction of arrow 52, (see FIG. 8) for the purpose of aligning detonator 34 with the firing mechanism.

The rate at which piston 28 travels in its return stroke (downward in FIGS. 8 and 9) is controlled by the degree of throttling of the gas as it is exhausted from high pressure chamber 47. Gas restrictor plug 46 may be fabricated of sintered steel the porosity of which can be varied at the time of assembly to select the desired period of delay. For the specific embodiment illustrated, the Navy specification sets forth a time delay of 0.050 to 0.200 seconds from the instant of removal of the arming pressure to the instant of fuze arming. The fuze was designed to provide arming upon a reduction of pressure to 15 psig after reaching "commit-to-arm" position.

When the high pressure gas acting on piston has been vented, piston 28 has moved downwardly to its lowermost position by the action of coiled spring 32. The piston simultaneously is rotated by the pin and cam slot to align detonator 34 with a firing mechanism 54 and the fuze is in an armed position. When piston 28 is in the armed position, another spring loaded detent 53 is aligned with one of the ports 36 to lock the piston in position.

Firing mechanism 54, shown in FIGS. 6, 9, and 10, is mounted in the base portion 56 of cylinder 26, and comprises a firing pin 58 slidably mounted in a side wall of base portion 56 so as to be aligned transversely with the armed position of detonator 34. A compression firing spring 59 is adapted to propel firing pin 58 in to stab detonator 34 for initiating the firing train; spring 59 also having the function of preventing premature firing as will be described. The firing pin is controlled by a sear mechanism which includes a U-shaped base 60 (FIG. 10), a sear beam 61 pivotally mounted on base 60 by a pin 62 riding in a notch 63. One side of notch 63 is formed vertical for a purpose presently to be described. The sear mechanism is provided with a ball pivot 66 seated in respective grooves in both the sear and the base of the cylinder. A roller 68 is mounted on sear 61 releasably to engage and restrain firing pin 58 under the compression force of firing spring 59.

The firing mechanism is maintained in a locked position by a U-shaped, upwardly bowed, safety spring 70 best shown in FIG. 10. The ends of spring arms 72 are constrained within a recess 74 in the base portion 56. Shoulder portion 76 of spring 70 is flat and normally interposed between sear beam 61 and base 59 to prevent the sear beam (and roller 68) from pivoting and releasing the firing pin (FIG. 10). When bowed spring 70 is depressed by piston extension 33 at the end of the arming stroke, sear beam is unlatched and firing pin 58 is in a fully armed position capable of initiating the explosive train upon impact with the intended target (FIG. 9).

OPERATION

FIGS. 2 and 6 illustrate the invention fuze in a safe condition wherein piston 28 is locked to the cylinder by detents 38. After missile 10 has reached a safe distance from the launching aircraft, warhead cannister 12 is pressurized with gas or the like (FIG. 3) and the external surfaces of detents 38 are subjected to the pressure buildup. When the pressure reaches a minimum selected design pressure (i.e., 40 psi) detents 38 are sufficiently depressed into the piston to unlock it and simultaneously admit the gas to chamber 47. Piston 28 commences to move (longitudinally upwardly) to compress arming spring 32. When the gas pressure reaches a minimum selected design pressure (i.e., 100 psi) piston 28 has moved rectilinearly to where cam pin 50 reaches cam slot portion **48*c* at which position the piston simultaneously rotates in the direction of arrow 52. Piston 28 has rotated relative to pin 50 from a position where it was in alignment with leg 48*a* to a position in alignment with leg 48*b*.** Thus, the fuze has been committed to be armed, referred to as a commit-to-arm position, and cannot in flight be restored to a safe position.

The commit-to-arm condition prevails until the missile 10 has reached the target area and, upon an appropriate signal to linear explosive charges 24, warhead cannister 12 is burst open dissipating the high pressure condition existing in that section and dispersing bomblets 16. High pressure gas in fuze chamber 47 begins to vent successively through gas restrictor 46, line 43, and ports 44 and 36. The illustrated device is planned to have a time delay of approximately 50 to 200 msec from the instant of removal of the 100 psi pressure to the instant of fuze arming, depending primarily on the selection of the degree of porosity of gas restrictor 46. This delay will afford sufficient time for the bomblets to disperse without the likelihood of premature explosion by accidental collision (see FIG. 5). As the pressure in chamber 47 dissipates, piston 28 under the cocked force of arming spring 32 begins its return arming stroke, the engagement of cam pin 50 and cam slot leg **48*b* causing piston 28 to continue to rotate in the direction of arrow 52.**

When the pressure in chamber 47 reaches 15 psig, piston 28 under the action of arming spring 32 has rotated to the full extent permitted by cam slot portion **48*b*, positioning piston extension 33 to align detonator 34 with firing pin 58 (see FIG. 9). Thus, detonator 34 has been moved from the safe position in FIG. 6 to the armed position in FIG. 9. Piston extension 33 has also depressed bowed spring 70 to unlatch sear beam 61. Firing pin 58 remains in the same position as in FIGS. 6 and 10,** but in this condition the fuze is in a fully armed position in which firing pin is capable of setting off the explosive train upon impact of the bomblet with a target.

It should be noted that although sear beam 61 is unlatched, the front face of firing pin 58 by action of compression firing spring 59 bears against sear roller 68 biasing the vertical edge of sear beam notch 63 against sear pivot 62 which maintains ball 66 in a seated condition.

Armed position locking detent 53 has rotated and translated down to a position to engage one of the ports 36 to lock the fuze in an armed position (FIG. 9). In this latched position detent 53 is visible through its engaged port 36 to reveal the armed condition of the fuze. It is desirable that detent 53 have a color code of red, and detents 38 be colored green so that the respective condition of the fuze is readily apparent.

Upon impact of the bomblet with the target, regardless of force direction with any of the intended targets, the inertial forces eject sear ball 66 from its seated position causing sear beam 60 to pivot and depress roller 68 or inertial forces on the roller end of sear beam 60 cause it to rotate. Firing pin 58 is now released and under the force of spring 59 is propelled into aligned detonator 34 to initiate the firing train, as shown in FIG. 9.

The weapon system of this invention provides a means for delivering a plurality of bomblets, each having a pressure sensitive fuze which fuzes can be committed-to-arm simultaneously by an artificial environment controlled by a highly reliable weapon safety arming device, increasing odds against accidental ignition. Because of this reason and the fact that the fuze does not rely on aerodynamic spinning for arming, it is safer from accidental dropping especially for shipborne equipment. If the mission is aborted the weapon and contained bomblets need not be jettisoned as has been the practice with spin-armed fuzes, and can be returned to the launching platform. The pressure sensitive fuze enables the bomblets to be armed more precisely, i.e., when the delivery aircraft is at a predetermined distance. The fuze is small and compact and capable of mass production. A more predictable and adjustable time-delay in the final arming of the fuze can be readily chosen at the time of assembly. The firing mechanism enables the fuze to be exploded by any omni-directional impact force.

Obviously many modifications and variations of the present invention are possible in the light of the above teachings. It is therefore to be understood that within the scope of the appended claims the invention may be practiced otherwise than as specifically described.

What is claimed is:

1. An air-droppable sealed warhead cannister containing a plurality of bomblets each having a pressure sensitive explosive fuze provided with a fluid inlet port:

means including a power source connected to the cannister for pressurizing said cannister in flight with a fluid at a predetermined event by admitting fluid pressure through said port to activate the fuzes to commit-to-arm condition;

means for fragmenting said cannister at a second predetermined event to disperse said bomblets into the atmosphere, and exhaust said pressure in the fuze to the atmosphere through said inlet port;

means for advancing the fuzes to an armed position when said pressure is exhausted;

whereby all of said fuzes can be committed-to-arm simultaneously after the cannister has reached a safe distance from the launching platform, the fuzes being advanced to armed conditions when said cannister is fragmented and the bomblets dispersed.

2. The combination of claim 1 wherein a pressure-releasable detent is provided in each fuze normally engaging said inlet port for latching said fuze in a safe condition until released by the fluid pressure.

3. The combination of claim 2 wherein a second detent is provided to engage said fluid port when the fuze is advanced to the armed position to lock said fuze in said armed position.

4. The combination of claim 1 wherein means are provided in the fuze to meter the exhausting fluid pressure to the atmosphere to provide a predetermined time delay in each fuze to insure safe dispersal of the bomblets from each other before the fuzes are finally armed.

5. The combination of claim 1 wherein the fuze is provided with a firing mechanism, a spring member locking said fuze in a safe position, said spring member being depressed when said fuze is advanced to the armed position to unlock said firing mechanism.

* * * * *